US010703976B2

(12) United States Patent
Honjo et al.

(10) Patent No.: US 10,703,976 B2
(45) Date of Patent: Jul. 7, 2020

(54) PYROLYZED COAL QUENCHER, COAL UPGRADE PLANT, AND METHOD FOR COOLING PYROLYZED COAL

(71) Applicant: MITSUBISHI HEAVY INDUSTRIES, LTD., Tokyo (JP)

(72) Inventors: Shintaro Honjo, New York, NY (US); Kiyotaka Kunimune, New York, NY (US); Motofumi Ito, New York, NY (US); Junji Asahara, New York, NY (US)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 468 days.

(21) Appl. No.: 14/641,684

(22) Filed: Mar. 9, 2015

(65) Prior Publication Data

US 2016/0264871 A1 Sep. 15, 2016

(51) Int. Cl.
*C10B 39/04* (2006.01)
*C10L 5/04* (2006.01)
(Continued)

(52) U.S. Cl.
CPC ..... *C10B 39/04* (2013.01); *C10B 39/10* (2013.01); *C10B 53/04* (2013.01); *C10L 5/04* (2013.01); *C10B 57/10* (2013.01); *C10L 5/10* (2013.01)

(58) Field of Classification Search
CPC ..... C10B 39/04; C10B 39/10; C10B 53/04; C10B 57/10; C10L 5/04; C10L 5/10
See application file for complete search history.

(56) References Cited

U.S. PATENT DOCUMENTS 4,173,530 A 11/1979 Smith et al.
4,178,150 A 12/1979 Flockenhaus et al.
(Continued)

FOREIGN PATENT DOCUMENTS

AU 2013/300971 A1 2/2015
CN 103007614 A 4/2013
(Continued)

OTHER PUBLICATIONS

Non-Final Office Action dated Jun. 30, 2016, issued in U.S. Appl. No. 14/641,780, (7 pages).
(Continued)

*Primary Examiner* — Dirk R Bass
(74) *Attorney, Agent, or Firm* — Westerman, Hattori, Daniels & Adrian, LLP

(57) ABSTRACT

A pyrolyzed coal quencher includes: a first water spray tube 79 that sprays water on pyrolyzed coal having a temperature of 300° C. or more obtained after pyrolyzing coal; a first cooling tube 80 that performs indirect cooling on the pyrolyzed coal obtained after spraying water by the first water spray tube 79 to a temperature of 100° C. or more; a second water spray tube 82 that sprays water on the pyrolyzed coal cooled by the first cooling tube 80 such that the pyrolyzed coal has a desired water content; and a second cooling tube 83 that performs indirect cooling on the pyrolyzed coal cooled by the first cooling tube 80 to a desired temperature of less than 100° C. Thus, the pyrolyzed coal can be promptly cooled and adjusted to a desired water content.

7 Claims, 2 Drawing Sheets

(51) Int. Cl.

| | |
|---|---|
| ***C10B 53/04*** | (2006.01) |
| ***C10B 39/10*** | (2006.01) |
| *C10L 5/10* | (2006.01) |
| *C10B 57/10* | (2006.01) |

(56) References Cited

U.S. PATENT DOCUMENTS

| | | | | |
|---|---|---|---|---|
| 4,421,520 | A | | 12/1983 | Matthews |
| 4,497,637 | A | | 2/1985 | Purdy et al. |
| 4,602,438 | A | | 7/1986 | Draper et al. |
| 4,705,533 | A | | 11/1987 | Simmons |
| 4,725,337 | A | | 2/1988 | Greene |
| 4,769,042 | A | | 9/1988 | Ito et al. |
| 5,322,530 | A | | 6/1994 | Merriam et al. |
| 5,423,891 | A | | 6/1995 | Taylor |
| 5,711,769 | A | * | 1/1998 | Rinker ..... C10B 39/00 201/28 |
| 2011/0041393 | A1 | | 2/2011 | Sugita et al. |
| 2014/0290130 | A1 | | 10/2014 | Supandi |
| 2014/0345193 | A1 | | 11/2014 | Nakagawa et al. |
| 2015/0027872 | A1 | | 1/2015 | Abe et al. |
| 2015/0175890 | A1 | | 6/2015 | Nakagawa et al. |
| 2015/0329793 | A1 | | 11/2015 | Kaneko et al. |
| 2016/0115100 | A1 | | 4/2016 | Glover et al. |

FOREIGN PATENT DOCUMENTS

| | | | |
|---|---|---|---|
| JP | 56-52960 | B2 | 12/1981 |
| JP | 61-250098 | A | 11/1986 |
| JP | 62-114033 | U | 7/1987 |
| JP | 63-210192 | A | 8/1988 |
| JP | 9-71791 | A | 3/1997 |
| JP | 2005-105029 | A | 4/2005 |
| JP | 2006-96615 | A | 4/2006 |
| JP | 2009-97783 | A | 5/2009 |
| JP | 2012-215316 | A | 11/2012 |
| JP | 2013-108700 | A | 6/2013 |
| JP | 2014-031462 | A | 2/2014 |
| JP | 2015-110689 | A | 6/2015 |
| WO | 2013/103097 | A1 | 7/2013 |
| WO | 2013/125476 | A1 | 8/2013 |
| WO | 2014/024504 | A1 | 2/2014 |
| WO | 2014/091827 | A1 | 6/2014 |

OTHER PUBLICATIONS

Non-Final Office Action dated Aug. 31, 2016, issued in U.S. Appl. No. 14/641,668, (8 pages).
International Search Report dated Mar. 15, 2016, issued in application No. PCT/JP2016/053483, with English translation. (4 pages).
Written Opinion dated Mar. 15, 2016, issued in application No. PCT/JP2016/0653483, with English Translation. (8 pages).
Internation Search Report dated May 10, 2016, issued in application No. PCT/JP2016/053486, with English translation. (4 pages).
Written Opinion dated Mar. 15, 2016, issued in application No. PCT/JP2016/053486, with English Translation. (6 pages).
International Search Report dated Mar. 15, 2016, issued in application No. PCT/JP2016/053488 with English translation. (2 pages).
Written Opinion dated Mar. 15, 2016, issued in application No. PCT/JP2016/053488, with English Translation. (6 pages).
International Search Report dated Mar. 15, 2016, issued in application No. PCT/JP2016/053482, with English translation. (4 pages).
Written Opinion dated Mar. 15, 2016, issued in application No. PCT/JP2016/053482, with English Translation. (6 pages).
International Search Report dated May 4, 2016, issued in application No. PCT/JP2016/053502, with English translation. (4 pages).
Written Opinion dated May 4, 2016, issued in application No. PCT/JP2016/053502, with English Translation. (8 pages).
Final Office Action dated Feb. 10, 2017, issued in U.S. Appl. No. 14/641,668. (11pages).
Non-Final Office Action dated Dec. 9, 2016, issued in U.S. Appl. No. 14/641,801. (21 pages).
Non-Final Office Action dated Jan. 17, 2017, issued in U.S. Appl. No. 14/641,788. (24 pages).
Non-Final Office Action dated Jun. 16, 2017, issued in related U.S. Appl. No. 14/641,780 (13 pages).
Final Office Action dated May 11, 2017, issued in related U.S. Appl. No. 14/641,801 (15 pages).
Non-Final Office Action dated May 23, 2017 issued in related U.S. Appl. No. 14/641,668 (10 pages).
Final Office Action dated Jul. 27, 2017, issued in related U.S. Appl. No. 14/641,788 (11 pages).
American Electric Power, Wet Flue Gas Desulfurization, (Year: 2005).
Final Office Action dated Nov. 15, 2017, issued in U.S. Appl. No. 14/641,780. (11 pages).
Final Office Action dated Nov. 2, 2017, issued in U.S. Appl. No. 14/641,668. (9 pages).
Office Action dated Nov. 23, 2017, issued in Australian Application No. 2016230473. (5 pages).
Non-Final Office Action dated Apr. 19, 2018, issued in U.S. Appl. No. 14/641,788. (11 pages).
Office Action dated Jul. 10, 2018, issued in Japanese Application No. 2017-504916, with English machine translation (4 pages).

* cited by examiner

PYROLYZED COAL QUENCHER, COAL UPGRADE PLANT, AND METHOD FOR COOLING PYROLYZED COAL

BACKGROUND OF THE INVENTION

1. Field of the Invention

The present invention relates to a pyrolyzed coal quencher which cools coal after pyrolyzing the coal, a coal upgrade plant, and a method for cooling pyrolyzed coal.

2. Description of Related Art

Since low ranking coal such as sub-bituminous coal and lignite has a lower carbonization degree and a higher water content than high ranking coal, a calorific value per unit weight is lower. However, since there are abundant deposits of low ranking coal, the low ranking coal is desired to be effectively used. Thus, various coal upgrading techniques have been studied in which the calorific value of the low ranking coal is increased by performing pyrolysis after drying the low ranking coal, and upgraded coal is deactivated so as to prevent spontaneous combustion during transportation or storage (e.g., Japanese Unexamined Patent Application, Publication No. 2014-31462 (hereinafter referred to as JPA 2014-31462)).

JPA 2014-31462 discloses that, after coal is pyrolyzed, the pyrolyzed coal is showered with cooling water to be cooled to about 50° C. to 60° C. at the time of cooling.

However, when the pyrolyzed coal is showered with cooling water and cooled to a condensation temperature of water or less, condensed water (drain water) is generated, and the pyrolyzed coal is exposed to the condensed water. In this case, it becomes difficult to adjust the pyrolyzed coal to a desired water content.

Since the pyrolyzed coal possibly generates heat to be ignited by a hydration reaction during storage, it is preferable to previously adjust the water content of the pyrolyzed coal to a water content in equilibrium with a storage environment.

Since the pyrolyzed coal obtained after the pyrolysis has a temperature of 300° C. or more to 500° C. or less, and a volatile content such as tar is generated by thermal decomposition, it is desirable to promptly cool the pyrolyzed coal in a quencher.

The present invention has been made in view of such circumstances, and an object thereof is to provide a pyrolyzed coal quencher, a coal upgrade plant, and a method for cooling pyrolyzed coal capable of promptly cooling pyrolyzed coal, and adjusting the pyrolyzed coal to a desired water content.

BRIEF SUMMARY OF THE INVENTION

To achieve the above object, a pyrolyzed coal quencher, a coal upgrade plant and a method for cooling pyrolyzed coal of the present invention employ the following solutions.

That is, a pyrolyzed coal quencher according to one aspect of the present invention includes: a first water spray section that sprays water on pyrolyzed coal having a temperature of 300° C. or more obtained after pyrolyzing coal; and a first cooling tube that performs indirect cooling on the pyrolyzed coal obtained after spraying water by the first water spray section to a temperature of 100° C. or more by a first cooling medium flowing within the first cooling tube.

In the above pyrolyzed coal quencher, water is sprayed on the pyrolyzed coal having a temperature of 300° C. or more obtained after the pyrolysis from the first water spray section. Accordingly, the pyrolyzed coal is promptly cooled to a temperature below 300° C., and the generation of a volatile content such as tar is suppressed. The first cooling tube then performs the indirect cooling to cool the pyrolyzed coal to a temperature of 100° C. or more (for example, about 150° C.). As described above, the pyrolyzed coal is immediately cooled by spraying water, and then cooled to a condensation temperature of water or more by the indirect cooling, so that the generation of the volatile content such as tar can be promptly suppressed, and the pyrolyzed coal can be prevented from being exposed to condensed water. Accordingly, it becomes possible to adjust the pyrolyzed coal to a desired water content.

In the pyrolyzed coal quencher according to one aspect of the present invention, the first cooling medium has an inlet temperature of 50° C. or more to less than 100° C. when introduced into the first cooling tube.

When the first cooling medium introduced into the first cooling tube has a low temperature, a large thermal stress may occur to cause cracks in the first cooling tube. Thus, by setting the inlet temperature of the first cooling medium to 50° C. or more to less than 100° C. (for example, about 60° C.) that is a temperature higher than a normal temperature, the cracks in the first cooling tube can be avoided.

In the pyrolyzed coal quencher according to one aspect of the present invention, the first cooling medium is boiler feed water.

Since the boiler feed water is deaerated, corrosion can be avoided even when the boiler feed water is used as the cooling medium of the cooling tube that is exposed to a high temperature. Also, since the boiler feed water can be easily obtained in a plant which performs coal pyrolysis, it is convenient to use the boiler feed water as the cooling medium.

The pyrolyzed coal quencher according to one aspect of the present invention further includes a first rotating vessel that receives the pyrolyzed coal and rotates about an axis, wherein the first water spray section and the first cooling tube are installed in the first rotating vessel.

A so-called rotary cooler type is employed in which the pyrolyzed coal is injected and treated in the first rotating vessel. Thus, the apparatus configuration can be simplified, and the equipment costs can be kept low.

The pyrolyzed coal quencher according to one aspect of the present invention further includes: a second water spray section that sprays water on the pyrolyzed coal cooled by the first cooling tube such that the pyrolyzed coal has a desired water content; and a second cooling tube that performs indirect cooling on the pyrolyzed coal cooled by the first cooling tube to a desired temperature of less than 100° C. by a second cooling medium flowing within the second cooling tube.

The pyrolyzed coal is set to a desired water content by spraying water from the second water spray section. However, when water is sprayed on the pyrolyzed coal, the pyrolyzed coal may be ignited with a temperature increased by hydration heat. Thus, the second cooling tube performs the indirect cooling to remove the hydration heat and cool the pyrolyzed coal to a desired temperature of less than 100° C. (for example, 50° C.). As described above, the adjustment of the water content can be completed by spraying water while removing the hydration heat. Also, since the water content can be set to a desired value in the second cooler, it is not necessary to spray water in order to adjust the water content in the following steps, and it is possible to avoid the possibility of ignition by the hydration heat.

The pyrolyzed coal quencher according to one aspect of the present invention further includes a second rotating vessel that receives the pyrolyzed coal and rotates about an axis, wherein the second water spray section and the second cooling tube are installed in the second rotating vessel.

A so-called rotary cooler type is employed in which the pyrolyzed coal is injected and treated in the second rotating vessel. Thus, the apparatus configuration can be simplified, and the equipment costs can be kept low.

A coal upgrade plant according to one aspect of the present invention includes a pyrolyzer that pyrolyzes coal, and the above pyrolyzed coal quencher that cools the pyrolyzed coal pyrolyzed by the pyrolyzer.

Since the coal upgrade plant includes the above pyrolyzed coal quencher, upgraded coal having a desired water content can be manufactured.

A method for cooling pyrolyzed coal according to one aspect of the present invention includes: a first water spraying step of spraying water on pyrolyzed coal having a temperature of 300° C. or more obtained after pyrolyzing coal; and a first cooling step of performing indirect cooling on the pyrolyzed coal obtained after spraying water by a water spray section to a temperature of 100° C. or more by a first cooling medium flowing within a cooling tube.

In the method for cooling pyrolyzed coal according to one aspect of the present invention, water is sprayed on the pyrolyzed coal having a temperature of 300° C. or more obtained after the pyrolysis. Accordingly, the pyrolyzed coal is immediately cooled to a temperature below 300° C., and the generation of tar or the like is suppressed. The indirect cooling is then performed in the first cooling step to cool the pyrolyzed coal to a temperature of 100° C. or more (for example, about 150° C.). As described above, the pyrolyzed coal is immediately cooled by spraying water, and then cooled to a condensation temperature of water or more by the indirect cooling, so that the generation of the volatile content such as tar can be promptly suppressed, and the pyrolyzed coal can be prevented from being exposed to condensed water. Accordingly, it becomes possible to adjust the pyrolyzed coal to a desired water content.

The pyrolyzed coal can be promptly cooled and adjusted to a desired water content.

DETAILED DESCRIPTION OF THE INVENTION

In the following, one embodiment according to the present invention is described by reference to the drawings.

Figure 1:
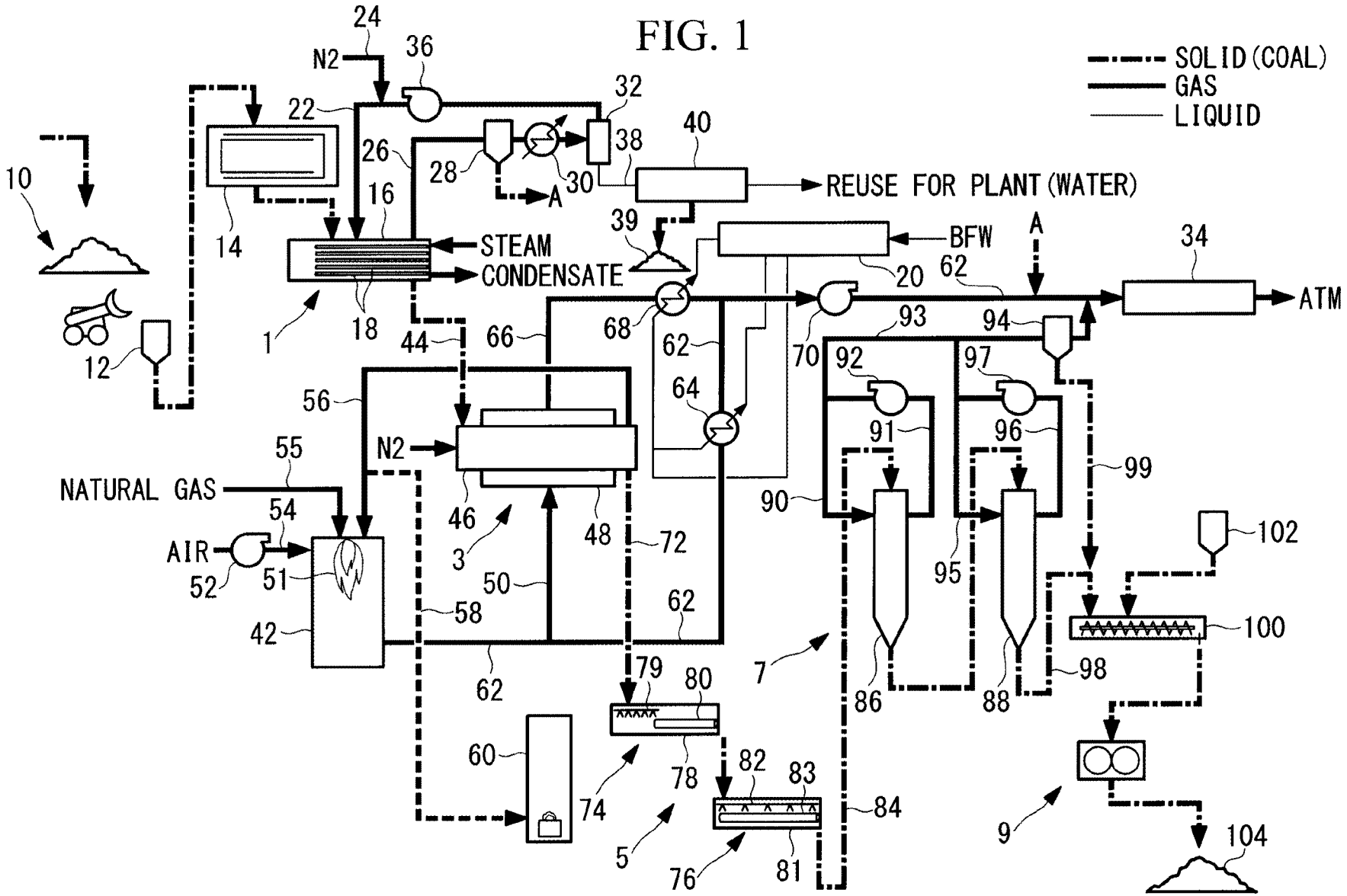
FIG. 1 is a schematic configuration diagram illustrating the entire configuration of a coal upgrade plant including a pyrolyzed coal quencher according to one embodiment of the present invention.

FIG. 1 shows a coal upgrade plant including a pyrolyzed coal quencher according to one embodiment of the present invention. The coal upgrade plant includes a dryer 1 that heats and dries coal, a pyrolyzer 3 that heats and pyrolyzes the dried coal dried in the dryer 1, a pyrolyzed coal quencher (simply referred to as "quencher" below) 5 that cools the pyrolyzed coal pyrolyzed in the pyrolyzer 3, a finisher 7 that deactivates the pyrolyzed coal cooled in the quencher 5, and a briquetter 9 that briquettes the upgraded coal deactivated by the finisher 7 into a predetermined shape.

A coal hopper 12 that receives raw coal 10 is provided on the upstream side of the dryer 1. The raw coal is low ranking coal such as sub-bituminous coal and lignite, and has a water content of 25 wt % or more to 60 wt % or less. The coal guided from the coal hopper 12 is crushed to a particle size of, for example, about 20 mm or less in a crusher 14.

The coal crushed in the crusher 14 is guided to the dryer 1. The dryer 1 is of indirect heating type using steam, and includes a cylindrical vessel 16 that rotates about a center axis, and a plurality of heating tubes 18 that are inserted into the cylindrical vessel 16. The coal guided from the crusher 14 is fed into the cylindrical vessel 16. The coal fed into the cylindrical vessel 16 is guided from one end side (the left side in FIG. 1) to the other end side while being agitated according to the rotation of the cylindrical vessel 16. Steam having a temperature of 150° C. or more to 200° C. or less (more specifically, 180° C.), which is produced in a steam system 20, is fed into each of the heating tubes 18, thereby indirectly heating the coal in contact with the outer periphery of each of the heating tubes 18. The steam fed into each of the heating tubes 18 is condensed after applying condensation heat by heating the coal, discharged from the dryer 1, and returned to the steam system 20.

A carrier gas is fed into the cylindrical vessel 16 through a carrier gas circulation path 22. As the carrier gas, an inert gas is used. More specifically, a nitrogen gas is used. When in shortage, the nitrogen gas is additionally fed from a nitrogen feed path 24 that is connected to the carrier gas circulation path 22. The carrier gas is discharged outside of the cylindrical vessel 16 through a carrier gas discharge path 26 that is connected to the cylindrical vessel 16 while catching a desorbed component (steam, pulverized coal, mercury, mercury-based substances, etc.) desorbed from the coal when passing through the cylindrical vessel 16.

A cyclone (dust collector) 28, a carrier gas cooler 30, and a scrubber 32 are provided in the carrier gas discharge path 26 sequentially from the upstream side of a carrier gas flow direction.

The cyclone 28 mainly removes the pulverized coal (for example, having a particle size of 100 μm or less) that is a solid from the carrier gas by use of a centrifugal force. The pulverized coal removed in the cyclone 28 is guided to the upstream side of a bag filter 34 as indicated by reference character A. The pulverized coal separated in the cyclone 28 may be also mixed into the dried coal dried in the dryer 1.

The carrier gas cooler 30 cools the carrier gas, from which the pulverized coal has been removed, thereby condensing steam guided together with the carrier gas and removing the condensed steam as drain water. The carrier gas cooler 30 is an indirect heat exchanger. Industrial water having a normal temperature is used as a cooling medium. Recycled water separated in a waste water treatment equipment 40 may be also used as the cooling medium. The drain water produced in the carrier gas cooler 30 is guided to a liquid phase section in a lower portion of the scrubber 32.

The scrubber 32 removes the mercury and/or the mercury-based substances (simply referred to as "mercury etc." below) from the carrier gas, from which the pulverized coal and the steam have been removed. Water is used as an absorber used in the scrubber 32. More specifically, the recycled water separated in the waste water treatment equipment 40 is used. The mercury etc. in the carrier gas is adsorbed by the water sprayed from above the scrubber 32, and guided to the liquid phase section in the lower portion of the scrubber 32. In the scrubber 32, the pulverized coal that could not be removed in the cyclone 28 is also removed.

An upstream end of the carrier gas circulation path 22 is connected to an upper portion of the scrubber 32. A blower 36 is provided at an intermediate position of the carrier gas circulation path 22. The carrier gas treated in the scrubber 32 is returned to the dryer 1 by the blower 36. Although not shown in the drawings, one portion of the carrier gas treated in the scrubber 32 is guided to a combustor 42.

The waste water treatment equipment 40 is connected to the lower portion of the scrubber 32 through a waste water path 38. The waste water treatment equipment 40 separates sludge 39, which is a solid content such as the pulverized coal and the mercury etc., and the recycled water by a sedimentation tank (not shown) after aggregating and enlarging the mercury etc. by injecting a chelating agent into waste water. The recycled water is reused in various portions of the plant.

The coal (dried coal) dried in the dryer 1 passes through a dried coal feed path 44 to be guided to the pyrolyzer 3 by use of its weight. The pyrolyzer 3 is an external-heat rotary kiln, and includes a rotating inner cylinder 46, and an outer cylinder 48 that covers the outer peripheral side of the rotating inner cylinder 46. A nitrogen gas as a carrier gas is fed into the rotating inner cylinder 46.

A combustion gas produced in the combustor 42 is guided to a space between the rotating inner cylinder 46 and the outer cylinder 48 through a combustion gas introduction path 50. Accordingly, the inside of the rotating inner cylinder 46 is maintained at 350° C. or more to 450° C. or less (for example, 400° C.)

To the combustor 42, an air feed path 54 that guides combustion air force-fed by a blower 52 into the combustor, a natural gas feed path 55 that guides a natural gas as fuel into the combustor, and a pyrolysis gas collection path 56 that collects a pyrolysis gas generated in the pyrolyzer 3 together with the carrier gas, and guides the gas into the combustor are connected. In the combustor 42, a fire 51 is formed by the natural gas, the pyrolysis gas, and the air fed into the combustor. Since the pyrolysis gas contains a volatile content such as tar and has a predetermined calorific value, the pyrolysis gas is used as fuel in the combustor 42. The natural gas fed from the natural gas feed path 55 is used for adjusting a calorific value of the fuel injected into the combustor 42. A flow rate of the natural gas is adjusted such that the combustion gas produced in the combustor 42 has a desired temperature.

A pyrolysis gas discharge path 58 that is used in emergency is connected to an intermediate position of the pyrolysis gas collection path 56. A flare stack 60 is installed on the downstream side of the pyrolysis gas discharge path 58. A combustible component such as tar in the pyrolysis gas is incinerated by the flare stack 60, and a gas obtained after the incineration is released to the atmosphere.

A combustion gas discharge path 62 through which the combustion gas produced in the combustor is discharged is connected to the combustor 42. An upstream end of the combustion gas introduction path 50 that guides the combustion gas to the pyrolyzer 3 is connected to an intermediate position of the combustion gas discharge path 62. A first medium-pressure boiler 64 is provided in the combustion gas discharge path 62 on the downstream side of a connection position with the combustion gas introduction path 50.

An after-heating gas discharge path 66 through which the combustion gas after heating the rotating inner cylinder 46 is discharged is connected to the outer cylinder 48 of the pyrolyzer 3. A second medium-pressure boiler 68 is provided in the after-heating gas discharge path 66. The after-heating gas discharge path 66 is connected to the combustion gas discharge path 62 on the downstream side. A blower 70 that force-feeds the combustion gas is provided in the combustion gas discharge path 62 on the downstream side of a connection position with the after-heating gas discharge path 66.

The downstream side of the combustion gas discharge path 62 is connected to the bag filter 34. A flue gas, from which combustion ash or the like is removed in the bag filter 34, is released to the atmosphere (ATM).

The steam system 20 includes the first medium-pressure boiler 64 and the second medium-pressure boiler 68. In the second medium-pressure boiler 68, boiler feed water (BFW) fed thereto is heated by the combustion gas flowing through the after-heating gas discharge path 66, thereby producing steam. In the first medium-pressure boiler 64, the steam produced in the second medium-pressure boiler 68 is guided, and heated by the flue gas flowing through the combustion gas discharge path 62, thereby producing steam having a higher pressure. Medium-pressure steam produced in the first medium-pressure boiler 64 and medium-pressure steam produced in the second medium-pressure boiler 68 are respectively stored in a steam drum (not shown), and fed to various portions of the plant such as the heating tubes 18 of the dryer 1.

The pyrolyzed coal pyrolyzed in the pyrolyzer 3 is guided to the quencher 5 through a pyrolyzed coal feed path 72 by use of gravity. The quencher 5 includes a first cooler 74 that receives the pyrolyzed coal from the pyrolyzer 3, and a second cooler 76 that receives the pyrolyzed coal cooled by the first cooler 74.

The first cooler 74 is a shell-and-tube heat exchanger, and includes a first cylindrical vessel (first rotating vessel) 78 that rotates about a center axis, a first water spray tube (first water spray section) 79 that is inserted into the first cylindrical vessel 78, and a plurality of first cooling tubes 80 that are inserted into the first cylindrical vessel 78. The first water spray tube 79 is installed in a stationary state with respect to the rotating first cylindrical vessel 78. The pyrolyzed coal having a temperature of 300° C. or more to 500° C. or less (for example, about 400° C.), which is guided from the pyrolyzer 3, is fed into the first cylindrical vessel 78. The pyrolyzed coal fed into the first cylindrical vessel 78 is guided from one end side (the left side in FIG. 1) to the other end side while being agitated according to the rotation of the first cylindrical vessel 78.

Industrial water having a normal temperature is guided to the first water spray tube 79. The water is sprayed on the pyrolyzed coal and thereby brought into direct contact with the pyrolyzed coal to cool down the pyrolyzed coal. The first water spray tube 79 is provided on the upstream side (the left side in FIG. 1) of the pyrolyzed coal moving within the first cylindrical vessel 78. The recycled water separated in the waste water treatment equipment 40 may be used as the water fed to the first water spray tube 79.

Boiler feed water having a temperature of 50° C. or more to 100° C. or less (for example, about 60° C.) is fed into each of the first cooling tubes 80, thereby indirectly cooling the pyrolyzed coal in contact with the outer periphery of each of the first cooling tubes 80. Each of the first cooling tubes 80 is provided on the downstream side (the right side in FIG. 1) of the pyrolyzed coal moving within the first cylindrical vessel 78. Each of the first cooling tubes 80 cools the pyrolyzed coal cooled by the first water spray tube 79 to about 150° C. that is equal to or higher than a condensation temperature of water.

The second cooler 76 has substantially the same configuration as the first cooler 74. The second cooler 76 is a shell-and-tube heat exchanger, and includes a second cylindrical vessel (second rotating vessel) 81 that rotates about a center axis, a second water spray tube (second water spray section) 82 that is inserted into the second cylindrical vessel 81, and a plurality of second cooling tubes 83 that are inserted into the second cylindrical vessel 81. The second water spray tube 82 is installed in a stationary state with respect to the rotating second cylindrical vessel 81. The pyrolyzed coal cooled to about 150° C. in the first cooler 74 is fed into the second cylindrical vessel 81. The pyrolyzed coal fed into the second cylindrical vessel 81 is guided from one end side (the left side in FIG. 1) to the other end side while being agitated according to the rotation of the second cylindrical vessel 81.

Industrial water having a normal temperature is guided to the second water spray tube 82. The water is sprayed on the pyrolyzed coal to adjust the water content of the pyrolyzed coal to a desired value (for example, 8 wt %). The second water spray tube 82 is provided over substantially the entire second cylindrical vessel 81 in an axial direction. The recycled water separated in the waste water treatment equipment 40 may be used as the water fed to the second water spray tube 82.

Industrial water having a normal temperature is guided into each of the second cooling tubes 83, thereby indirectly cooling the pyrolyzed coal in contact with the outer periphery of each of the second cooling tubes 83. Each of the second cooling tubes 83 cools the pyrolyzed coal to about 50° C. The recycled water separated in the waste water treatment equipment 40 may be used as the water fed to each of the second cooling tubes 83.

The pyrolyzed coal cooled in the quencher 5 is guided to the finisher 7 through a cooled pyrolyzed coal feed path 84.

The finisher 7 includes a first deactivator 86 that receives the pyrolyzed coal cooled in the quencher 5, and a second deactivator 88 that receives the pyrolyzed coal from the first deactivator 86.

An oxidation gas having an oxygen concentration of about 0.5 to 3.0% is guided into the first deactivator 86 from a first oxidation gas feed path 90. Although not shown in the drawings, oxygen (more specifically, air) is fed to the first oxidation gas feed path 90 so as to adjust the oxygen concentration to a desired value.

The oxidation gas fed into the first deactivator 86 oxidizes an active spot (radical) generated by the pyrolysis to deactivate the pyrolyzed coal within the first deactivator 86. The oxidation gas discharged from the first deactivator 86 is guided to a first blower 92 through a first oxidation gas outlet tube 91 together with the pulverized coal. The oxidation gas force-fed by the first blower 92 is guided to the first oxidation gas feed path 90 again, and recirculated. The oxidation gas guided not to the first oxidation gas feed path 90, but to an oxidation gas discharge tube 93 is guided to a cyclone 94. The solid content such as the pulverized coal is separated from the oxidation gas guided to the cyclone 94 in the cyclone 94, and the resultant gas is guided to the bag filter 34 and released to the atmosphere (ATM). The solid content such as the pulverized coal separated in the cyclone 94 is fed to a kneader 100.

The pyrolyzed coal is injected from an upper portion of the first deactivator 86, and deactivated in contact with the oxidation gas while descending. The pyrolyzed coal retained in a lower portion of the first deactivator 86 is taken out from the lower portion, and guided to an upper portion of the second deactivator 88.

An oxidation gas having an oxygen concentration of about 8.0 to 12.0% is guided into the second deactivator 88 from a second oxidation gas feed path 95. Although not shown in the drawings, oxygen (more specifically, air) is fed to the second oxidation gas feed path 95 so as to adjust the oxygen concentration to a desired value.

The oxidation gas fed into the second deactivator 88 further deactivates the pyrolyzed coal deactivated in the first deactivator 86. The oxidation gas discharged from the second deactivator 88 is guided to a second blower 97 through a second oxidation gas outlet tube 96 together with the pulverized coal. The oxidation gas force-fed by the second blower 97 is guided to the second oxidation gas feed path 95 again, and recirculated. The oxidation gas guided not to the second oxidation gas feed path 95, but to the oxidation gas discharge tube 93 is guided to the cyclone 94. The solid content such as the pulverized coal is separated from the oxidation gas, and the resultant gas is guided to the bag filter 34 and released to the atmosphere.

The upgraded coal deactivated in the finisher 7 has a particle size of about 1 mm. The upgraded coal passes through an upgraded coal feed path 98 to be guided to the kneader 100. The pulverized coal separated in the cyclone 94 is guided to the upgraded coal feed path 98 through a pulverized coal collection path 99.

A binder guided from a binder feed section 102, the upgraded coal including the pulverized coal, and water are fed to and kneaded in the kneader 100. Examples of the binder include polyethylene oxide and starch. The upgraded coal kneaded in the kneader 100 is guided to the briquetter 9.

The briquetter 9 includes a female mold where a plurality of recessed portions having a shape corresponding to the product shape of the upgraded coal are formed, and a male mold that compresses the upgraded coal fed into the recessed portions by pressing. The upgraded coal briquetted in the briquetter 9 becomes upgraded coal 104 as a product. The upgraded coal 104 has a size of about several cm, and has a water content of 6 wt % or more to 9 wt % or less. Note that the water content of the upgraded coal 104 is based on a dry weight when the water content is in equilibrium with a storage environment, and the water content largely depends on relative humidity of the storage environment, but does not much depend on the temperature. For example, PRB (powder river basin) coal has a water content of about 8 wt % when the relative humidity is 90%.

Figure 2:
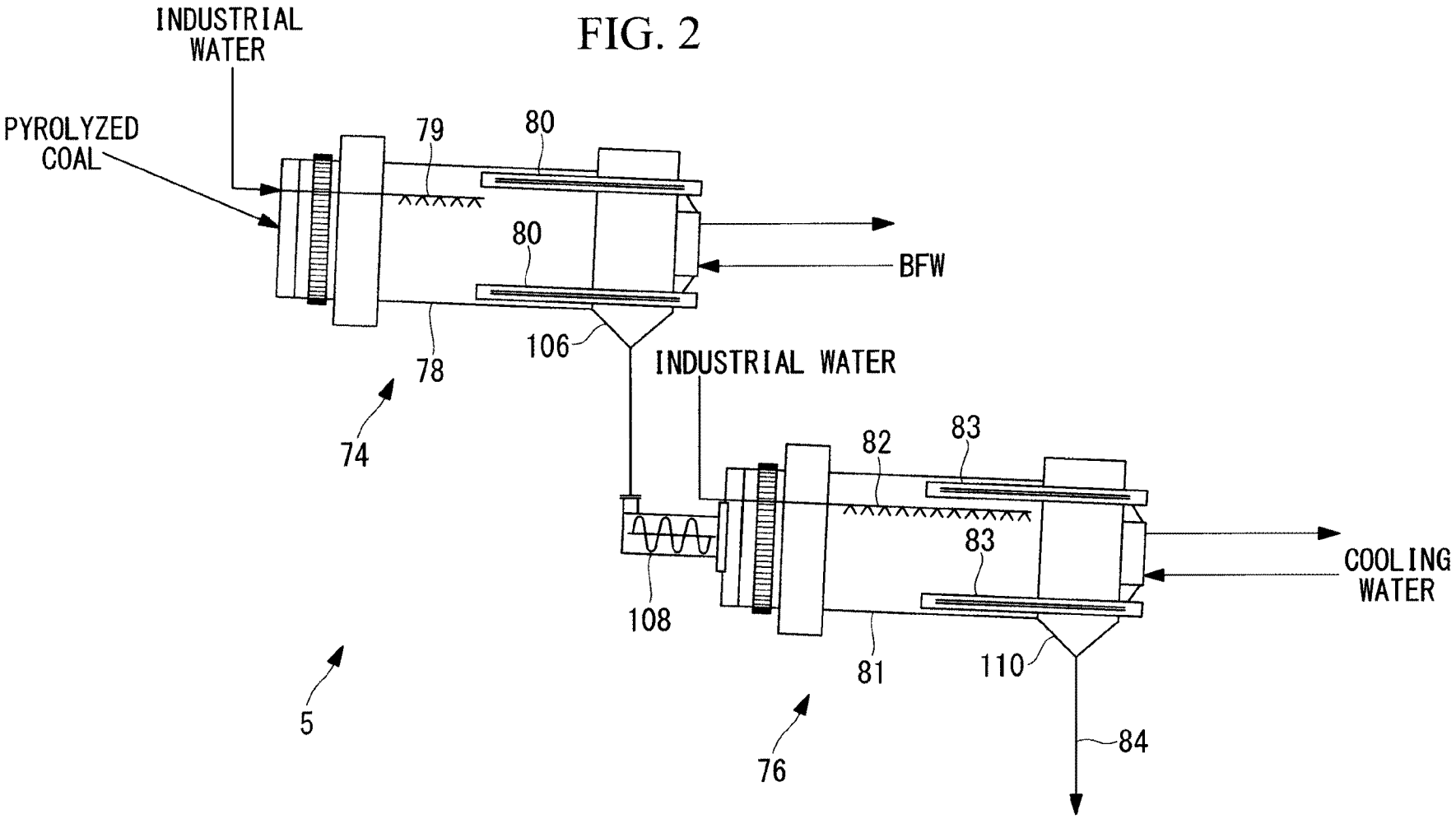
FIG. 2 is a configuration diagram specifically illustrating the pyrolyzed coal quencher shown in FIG. 1.

Next, the features of the present embodiment are described by using FIG. 2.

FIG. 2 specifically shows the configuration of the quencher 5 shown in FIG. 1. The same components as those shown in FIG. 1 are assigned the same reference numerals.

As shown in FIG. 2, in the first cylindrical vessel 78 and the second cylindrical vessel 81, each of the rotating axes is inclined with respect to a horizontal direction such that the other end side (the right side in the drawing) is located at a lower position. By inclining the rotating axes, the pyrolyzed coal injected into the one end side (the left side in the drawing) of each of the cylindrical vessels 78 and 81 is transferred to the other end side by the action of gravity while being agitated.

In the first cooler 74, the industrial water having a normal temperature is sprayed on the pyrolyzed coal from the first water spray tube 79. Since the water is directly sprayed on the pyrolyzed coal as described above, the pyrolyzed coal injected at a temperature of 300° C. or more to 500° C. or less (for example, about 400° C.) is promptly cooled to a temperature of less than 300° C. Accordingly, the generation of a volatile content such as tar from the pyrolyzed coal having a temperature of 300° C. or more is promptly suppressed. The first cooling tubes 80 then perform the indirect cooling to further cool the pyrolyzed coal to a temperature equal to or higher than 100° C. that is the condensation temperature of water (for example, 150° C.). As described above, even when the water is brought into direct contact with the pyrolyzed coal by the first water spray tube 79, the indirect cooling is performed on the downstream side to maintain the pyrolyzed coal at the condensation temperature of water or more. Thus, drain water is not generated by the condensation of water.

Steam generated in the first cylindrical vessel 78 is released outside of the first cylindrical vessel 78 by a carrier gas guided from an introduction section (not shown). The water content of the pyrolyzed coal discharged from the first cylindrical vessel 78 thereby becomes about 0%.

The boiler feed water (BFW) having an inlet temperature of 50° C. or more to less than 100° C. (for example, 60° C.) is used as a cooling medium fed to the first cooling tubes 80. For example, when the inlet temperature is about 60° C., the boiler feed water after passing through the first cooling tubes 80 has a temperature of about 80° C.

The pyrolyzed coal cooled in the first cooler 74 is guided from a first chute 106 to a feeder 108 located below the first chute 106 by use of gravity. The pyrolyzed coal having a temperature of 100° C. or more to less than 300° C. (for example, 150° C.) is guided into the second cylindrical vessel 81 by the feeder 108.

In the second cooler 76, the industrial water having a normal temperature is sprayed on the pyrolyzed coal from the second water spray tube 82. The amount of the water injected from the second water spray tube 82 is adjusted such that a desired water content is obtained for the pyrolyzed coal having a water content of about 0%. A value in equilibrium with a storage environment in which the pyrolyzed coal is stored is employed as the desired value of the water content.

The second cooling tubes 83 perform the indirect cooling on the pyrolyzed coal to a desired temperature of less than 100° C. (for example, 50° C.). The industrial water having a normal temperature is used as a cooling medium of the second cooling tubes 83. The second cooling tubes 83 decrease the temperature of the pyrolyzed coal, and also remove hydration heat generated when a hydration reaction is caused between the water fed from the second water spray tube 82 and the pyrolyzed coal.

Steam generated in the second cylindrical vessel 81 is released outside of the second cylindrical vessel 81 by a carrier gas guided from an introduction section (not shown).

As described above, the pyrolyzed coal is cooled to about 50° C. within the second cooler 76. The pyrolyzed coal is guided to the cooled pyrolyzed coal feed path 84 from a second chute 110, and guided to the finisher 7 in the next step (see FIG. 1).

As described above, the following effects are produced by the present embodiment.

The pyrolyzed coal having a temperature of 300° C. or more after the pyrolysis is promptly cooled to a temperature below 300° C. by spraying water from the first water spray tube 79. Thus, the generation of the volatile content such as tar can be suppressed. The first cooling tubes 80 then perform the indirect cooling to cool the pyrolyzed coal to a temperature of 100° C. or more (for example, about 150° C.). As described above, the pyrolyzed coal is immediately cooled by spraying water, and then cooled to the condensation temperature of water or more by the indirect cooling, so that the generation of the volatile content such as tar can be promptly suppressed, and the pyrolyzed coal can be prevented from being exposed to condensed water. Accordingly, it becomes possible to adjust the pyrolyzed coal to a desired water content.

When the cooling medium introduced into the first cooling tubes 80 has a low temperature, a large thermal stress may occur to cause cracks in the first cooling tubes 80. Thus, by setting the inlet temperature of the boiler feed water that is the cooling medium to 50° C. or more to less than 100° C. (for example, about 60° C.) that is a temperature higher than a normal temperature, the cracks in the first cooling tubes 80 can be avoided.

The boiler feed water is used as the cooling medium used in the first cooling tubes 80. Since the boiler feed water is deaerated, corrosion can be avoided even when the boiler feed water is used as the cooling medium of the first cooling tubes 80 that are exposed to a high temperature. Also, since the boiler feed water can be easily obtained in a plant which performs coal pyrolysis, it is convenient to use the boiler feed water as the cooling medium.

A so-called rotary cooler type is employed for the first cooler 74 in which the pyrolyzed coal is injected and treated in the first cylindrical vessel 78. Thus, the apparatus configuration can be simplified, and the equipment costs can be kept low. Similarly, a so-called rotary cooler type is employed for the second cooler 76 in which the pyrolyzed coal is injected and treated in the second cylindrical vessel 81. Thus, the apparatus configuration can be simplified, and the equipment costs can be kept low.

The pyrolyzed coal is set to a desired water content by spraying water from the second water spray tube 82, and the second cooling tubes 83 perform the indirect cooling to remove the hydration heat and cool the pyrolyzed coal to a desired temperature of less than 100° C. (for example, 50° C.). As described above, the adjustment of the water content can be completed by spraying water while removing the hydration heat in the second cooler 76. Also, since the water content can be set to a desired value in the second cooler 76, it is not necessary to spray water in order to adjust the water content in the following steps, and it is possible to avoid the possibility of ignition by the hydration heat.

1 Dryer
3 Pyrolyzer
5 Quencher
7 Finisher
9 Briquetter
10 Raw coal
12 Coal hopper
14 Crusher
16 Cylindrical vessel
18 Heating tube
20 Steam system
22 Carrier gas circulation path
28 Cyclone
30 Carrier gas cooler
32 Scrubber
34 Bag filter
40 Waste water treatment equipment
42 Combustor
46 Rotating inner cylinder
48 Outer cylinder
50 Combustion gas introduction path
74 First cooler
76 Second cooler
78 First cylindrical vessel
79 First water spray tube

80 First cooling tube
81 Second cylindrical vessel
82 Second water spray tube
83 Second cooling tube
86 First deactivator
88 Second deactivator
100 Kneader
104 Upgraded coal

What is claimed is:

1. A pyrolyzed coal quencher comprising:

a first water spray section supplied with pyrolyzed coal having a temperature of 300° C. or more obtained after pyrolyzing coal, and configured to spray water on the pyrolyzed coal;

a first cooling tube provided on a downstream side in a flow direction of the pyrolyzed coal with respect to the first water spray section, supplied with the pyrolyzed coal obtained after spraying water by the first water spray section, and configured to indirectly cool the pyrolyzed coal being in contact with an outer periphery of the first cooling tube to a temperature of 100° C. or more by a first cooling medium flowing within the first cooling tube, so that a water content of the pyrolyzed coal is adjusted;

a second water spray section provided on a downstream side in the flow direction of the pyrolyzed coal with respect to the first cooling tube, supplied with the pyrolyzed coal cooled by the first cooling tube, and configured to adjust an amount of water and spray the adjusted amount of water on the pyrolyzed coal such that the pyrolyzed coal has a desired water content, and a second cooling tube provided on a downstream side in the flow direction of the pyrolyzed coal with respect to the second water spray section, the second cooling tube having an overlap with the second water spray section and supplied with the pyrolyzed coal cooled by the first cooling tube, and configured to perform indirect cooling on the pyrolyzed coal to a desired temperature of less than 100° C. by a second cooling medium flowing within the second cooling tube.

2. The pyrolyzed coal quencher according to claim 1, wherein the first cooling medium has an inlet temperature of 50° C. or more to less than 100° C. when introduced into the first cooling tube.

3. The pyrolyzed coal quencher according to claim 2, wherein the first cooling medium is boiler feed water.

4. The pyrolyzed coal quencher according to claim 1, further comprising a first rotating vessel for receiving the pyrolyzed coal and rotating about an axis, wherein the first water spray section and the first cooling tube are installed in the first rotating vessel.

5. The pyrolyzed coal quencher according to claim 1, further comprising a second rotating vessel for receiving the pyrolyzed coal and rotating about an axis, wherein the second water spray section and the second cooling tube are installed in the second rotating vessel.

6. A coal upgrade plant comprising:

a pyrolyzer for pyrolyzing coal, and a pyrolyzed coal quencher according to claim 1 that cools the pyrolyzed coal pyrolyzed by the pyrolyzer.

7. A method for cooling pyrolyzed coal comprising:

a first water spraying step of spraying water on pyrolyzed coal having a temperature of 300° C. or more obtained after pyrolyzing coal;

a first cooling step of indirectly cooling the pyrolyzed coal obtained after spraying water on the pyrolzed coal in the first water spraying step and being in contact with an outer periphery of a first cooling tube to a temperature of 100° C. or more by a first cooling medium flowing within the first cooling tube, so that a water content of the pyrolyzed coal is adjusted;

a second water spraying step of adjusting an amount of water and spraying the adjusted amount of water on the pyrolyzed coal cooled in the first cooling step such that the pyrolyzed coal has a desired water content, and a second cooling step of indirectly cooling the pyrolyzed coal obtained after spraying water on the pyrolyzed coal in the second water spraying step to a desired temperature of less than 100° C. by a second cooling tube supplied with the pyrolyzed coal cooled by the first cooling tube and by a second cooling medium flowing within the second cooling tube, wherein the second cooling tube is configured such that there is an overlap section where the pyrolyzed coal is simultaneously subjected to spraying by water in the second water spraying step and indirect cooling by the second cooling tube in the second cooling step.

* * * * *